US006250488B1

(12) United States Patent
Narahara et al.

(10) Patent No.: US 6,250,488 B1
(45) Date of Patent: Jun. 26, 2001

(54) REPETITIVELY USEABLE CONTAINER INNER BAG

(75) Inventors: Kazumi Narahara, Tokyo; Norio Yamaguchi, Chiba; Toshihiro Omine, Ehime; Saburo Hashimoto, Tokyo, all of (JP)

(73) Assignees: Suntory Limited; Naviteco, Ltd.; Navix Techno Trade Co., Ltd.; Hashimoto Industrial Co., Ltd., all of (JP)

( * ) Notice: Subject to any disclaimer, the term of this patent is extended or adjusted under 35 U.S.C. 154(b) by 0 days.

(21) Appl. No.: 09/355,385

(22) PCT Filed: Dec. 7, 1998

(86) PCT No.: PCT/JP98/05505

§ 371 Date: Jul. 27, 1999

§ 102(e) Date: Jul. 27, 1999

(87) PCT Pub. No.: WO99/29597

PCT Pub. Date: Jun. 17, 1999

(30) Foreign Application Priority Data

Dec. 5, 1997 (JP) ..... 9-335241
Dec. 7, 1998 (WO) ..... PCT/JP98/05505

(51) Int. Cl.[7] ..... B65D 90/04

(52) U.S. Cl. ..... 220/1.6; 220/495.01; 220/495.05; 220/495.06

(58) Field of Search ..... 220/1.6, 1.5, 62, 220/495.01, 495.03, 495.05, 495.06; 383/4, 64, 66, 97, 9

(56) References Cited

U.S. PATENT DOCUMENTS 4,557,400 * 12/1985 Clarke .
4,674,127 6/1987 Yamada et al. .
4,784,287 11/1988 Yamada et al. .
5,222,621 * 6/1993 Matias ..... 220/470
5,482,425 * 1/1996 Podd, Jr. et al. ..... 220/1.6
5,824,995 * 10/1998 Wise ..... 219/393

FOREIGN PATENT DOCUMENTS 0 598 166 5/1994 (EP) .
1167076 6/1989 (JP) .
272079 3/1990 (JP) .
2282089 11/1990 (JP) .
7223673 2/1994 (JP) .

OTHER PUBLICATIONS

Japanese Utility Model Application No. 2–18432 (Ogawa Tent Co., Ltd.), dated Nov. 9, 1991.
Japanese Utility Model Application No. 60–99274 (Nippon Yusen K.K.), dated Jan. 20, 1987.
Japanese Utility Model Application No. 3–107973 (Ogawa Tent Co., Ltd.), dated Feb. 8, 1994.
Japanese Utility Model Application No. 57–196247 (K.K. National Marin Plastic), dated Jul. 17, 1984.

* cited by examiner

*Primary Examiner*—Stephen Castellano
(74) *Attorney, Agent, or Firm*—Bachman & LaPointe, P.C.

(57) ABSTRACT

A container inner bag mounted in a freight container and filled with a large amount of content, which is made of a synthetic resin sheet and has an elongated rectangular parallelepiped shape and a pentahedral or hexahedral structure. The elongated rectangular parallelepiped-shaped container inner bag is cut along at least ridge portions formed between the front and rear walls and the left and right side walls. These walls are adapted to be joined and separated along the ridge portions by connecting and separating means such as a fastener, respectively. The front wall has, at the upper portion, a cut portion adapted to form a content insertion opening through which the content is filled into the bag, and, at the lower portion, a cut portion adapted to form a content takeout opening through which the content is taken out from the bag. These cut portions are adapted to be joined and separated by connecting and separating means such as a fastener, respectively.

11 Claims, 12 Drawing Sheets

REPETITIVELY USEABLE CONTAINER INNER BAG

TECHNICAL FIELD

The present invention relates to a repetitively useable container inner bag, and more particularly to an inner bag for a container that is used upon bulk transportation of cargo (grain), for instance, by shipping.

BACKGROUND ART

Conventionally, in the case of transporting bulk grain by using shipping containers, first, bulk grain is filled, at the production district, in container inner bags that are provided along an inner surface of containers. The container inner bags are formed into an elongated rectangular parallelepiped shape and made of synthetic resin, such as vinyl chloride, polyethylene and the like. The containers having the inner bags filled with the bulk grain are then transported to destinations, respectively. Doors of the containers transported are opened and the bulk grain within the inner bags is taken out by cutting out a front portion of the inner bags and transferred to storage facilities.

Further, in Japanese Patent Application First Publication (KOKAI) No. 7-223673, there has been proposed a parallelepiped-shaped container inner bag of a two-piece type that includes a front wall portion and a rear elongated rectangular portion. The front wall portion is cut to form a takeout aperture and then discarded. A new front wall portion is mounted to the rear elongated rectangular portion, whereby the container inner bag can be partly reused.

Specifically, the inner bag is made of synthetic resin and has a generally rectangular parallelepiped shape as shown in FIG. 14. One end portion 201 of the inner bag is formed at its upper part with a content insertion aperture 202 through which a large amount of content can be filled into the inner bag. After taking out the content from the inner bag, the front portion including a broken portion 203 that is cut out to form an opening, is removed from the remaining portion 204 and then a new front portion is fitted to the remaining portion. Thus, the inner bag has a reusable construction.

Such the partly reusable inner bag has been proposed in order to eliminate the following disadvantages of the conventionally used inner bag of an integral-sealing type by adopting a split-mounting structure. Since the conventionally used inner bag must be cut to form an aperture for taking out the content from the inner bag by using a cutting member such as a knife, the inner bag must be discarded once used. It will be required to prepare a new inner bag for the subsequent bulk shipment, causing increase in cost. However, the partly reusable inner bag proposed is constructed such that the portion, i.e., the front portion, is cut to form the content takeout aperture by using the cutting member such as a knife as well as the conventional inner bag. The front portion cut is discarded and then replaced by the new one for reuse of the whole inner bag. Thus, the partly reusable inner bag proposed requires complicated structural elements due to forming and mounting means such as sewing for withstanding the cargo weight (for preventing bulge and deformation of the bag), and further necessitates members required for the partial replacement and the mounting cost thereof.

An object of the present invention is to provide a container inner bag adapted to be repetitively used as a whole in ship transportation and discharge operation of a bulk container for a large amount of grain such as malt.

Another object of the present invention is to provide a container inner bag capable of being easily cleaned.

A further object of the present invention is to provide a container inner bag exhibiting a good installation (mounting and removal) performance.

A still further object of the present invention is to provide a container inner bag having a good performance in insertion and takeout of the content.

DISCLOSURE OF INVENTION

According to one aspect of the present invention, there is provided a container inner bag mounted into a freight container and filled with a large amount of content. The container inner bag is made of a synthetic resin sheet and has an elongated rectangular parallelepiped shape including at least a bottom wall, front and rear walls and left and right side walls.

The elongated rectangular parallelepiped-shaped container inner bag is cut along at least ridges at which the front wall encounters the left and right side walls and ridges at which the rear wall encounters the left and right side walls. The front wall and the left and right side walls are adapted to be joined and separated along the ridges formed between the front wall and the left and right side walls by connecting and separating means such as a fastener. The rear wall and the left and right side walls are adapted to be joined and separated along the ridges formed between the rear wall and the left and right side walls by connecting and separating means such as a fastener. The front wall has, at an upper portion thereof, a cut portion adapted to form a content insertion opening through which the content is filled into the bag, and, at a lower portion thereof, a cut portion adapted to form a content takeout opening through which the content is taken out of the bag. These cut portions are adapted to be joined and separated by connecting and separating means such as a fastener, respectively.

Upon inserting the content into the bag, the cut portion adapted to form the content insertion opening is separated by the connecting and separating means to form the content insertion opening and then the content is filled into the bag through the content insertion opening. After the insertion of the content, the cut portion is joined by the connecting and separating means to close the content insertion opening. Upon taking the content out of the bag, the cut portion adapted to form a content takeout opening is separated by the connecting and separating means to form the content takeout opening and then the content is taken out of the bag through the content takeout opening. After taking out the content, the cut portion is joined by the connecting and separating means to close the content takeout opening. Thus, the container inner bag is so constructed as to be repetitively usable. Further, since the container inner bag is adapted to be developed into one flat sheet made of synthetic resin, the container inner bag can be readily cleaned.

According to another aspect of the present invention, the container inner bag has a hexahedral structure including the bottom wall, the front and rear walls, the left and right side walls and a top wall. The front and rear walls and the left and right side walls are so constructed as to be joined and separated by the respective connecting and separating means along the ridges formed between the front wall and the left and right side walls and between the rear wall and the left and right side walls. Further, the front and rear walls, the left and right side walls and the top wall are so constructed as to be joined and separated by the connecting and separating means along three ridges among four ridges formed between the front and rear walls and the left and right side walls and the top wall. Therefore, the container inner bag can effectively prevent dust from entering thereinto and the content from leaking out thereof.

According to a further aspect of the present invention, the container inner bag has a pentahedral structure including the bottom wall, the front and rear walls and the left and right side walls. The front and rear walls and the left and right side walls are so constructed as to be joined and separated by the connecting and separating means along the ridges formed between the front wall and the left and right side walls and the ridges formed between the rear wall and the left and right side walls, respectively. Therefore, the pentahedral container inner bag can be structurally simplified and easily handled as compared with the hexahedral one.

According to a still further aspect of the present invention, the cut portion adapted to form the content insertion opening, of the container inner bag, includes a first cut segment disposed at a center of the front wall in a width direction and having a predetermined length extending in a vertical direction. The cut portion also includes a second cut segment connected at one end thereof with an upper end of the first cut segment and extending along the ridge formed between the front wall and the top wall and the ridge formed between the front wall and one of the side walls. The cut portion further includes a third cut segment connected at one end thereof with the one end of the second cut segment and the upper end of the first cut segment and extending along the ridge formed between the front wall and the top wall and the ridge formed between the front wall and the other of the side walls. In addition, the cut portion adapted to form the content takeout opening is so arranged as to define a mountain-like triangular portion whose left and right ridge lines extend from a center located approximately on an elongation line of the first cut segment toward the left and right corners of the front wall. With this structure, the content insertion opening can be brought into a full-open state by separating all of the three cut segments or the second and third cut segments. The content insertion opening also can be brought into a left half or right half open state by separating the first and second cut segments or the first and third cut segments.

According to a still further aspect of the present invention, the cut portion adapted to form the content insertion opening, of the container inner bag is disposed at a center of the front wall in a width direction and has a predetermined length substantially vertically extending from an upper end of the front wall toward a lower end thereof. Further, the cut portion adapted to form the content takeout opening is so arranged as to define a mountain-like triangular portion whose left and right ridge lines extend from a center located approximately on an elongation line of the cut portion adapted to form the content insertion opening, toward the left and right corners of the front wall. With this structure, the content insertion opening can be brought into a right half or left half open state by separating the corresponding cut portion. The content insertion opening also can be brought into a full-open state by moving the connecting and separating means (slide fastener) disposed on both right and left sides of the front wall. Further, since the cut portion adapted to form the content takeout opening is so arranged as to define the mountain-like triangular portion, the connecting and separating means for joining and separating the cut portion can be prevented from being jammed into a lower portion of the bag upon filling the content into the bag.

According to a still further aspect of the present invention, the connecting and separating means in the container inner bag include a slide fastener. Therefore, each of the cut portions can be joined and separated by simply sliding a slider of the slide fastener.

According to a still further aspect of the present invention, the cut portion adapted to form the content takeout opening, of the container inner bag is arranged such that an apex of the mountain-like triangular portion is offset right or left from the center of the front wall in the width direction. With this arrangement, even when either one of right and left doors of the container is opened, the content takeout opening can be formed by separating the corresponding cut portion.

According to a still further aspect of the present invention, the container inner bag includes a leak preventing flap for preventing the content from leaking from near the apex of the mountain-like triangular portion defined by the cut portion adapted to form the content takeout opening. The leak preventing flap is disposed behind the apex. With the provision of the leak preventing flap, the content can be prevented from leaking out of the content takeout opening in a case where the cut portion is partly separated near the apex of the mountain-like triangular portion due to loosening of the slide fastener acting as the connecting and separating means.

According to a still further aspect of the present invention, the container inner bag includes a pipe support provided for mounting a reinforcing pipe. The pipe support is disposed on the front wall. With this structure, the front wall can be reinforced by the reinforcing pipe and a pressure of the content within the bag can be prevented from being applied to the doors of the container.

According to a still further aspect of the present invention, engaging members engageable with hooks disposed inside the container are disposed near four corners of each of the left and right side walls of the container inner bag. The engaging members are configured to a C-shape having a cutout portion that is cut out from a generally circular ring shape. The cutout portion is opened and closed by a tubular cutout-portion opening and closing member made of plastics. The container inner bag can be installed in the container by using the engaging members. Specifically, since the engaging members are configured to the C-shape having the cutout portion that is to be opened and closed by the tubular plastic cutout-portion opening and closing member, the engaging members can be readily and securely attached to the corresponding container hooks and detached therefrom.

According to a still further aspect of the present invention, expandable wall portions are disposed on the left and right side walls of the container inner bag. Therefore, in a case where the left and right side walls are swelled by the content filled into the container inner bag, the expandable wall portions can allow further expansion of the left and right side walls.

BEST MODE FOR CARRYING OUT THE INVENTION

Figure 1:
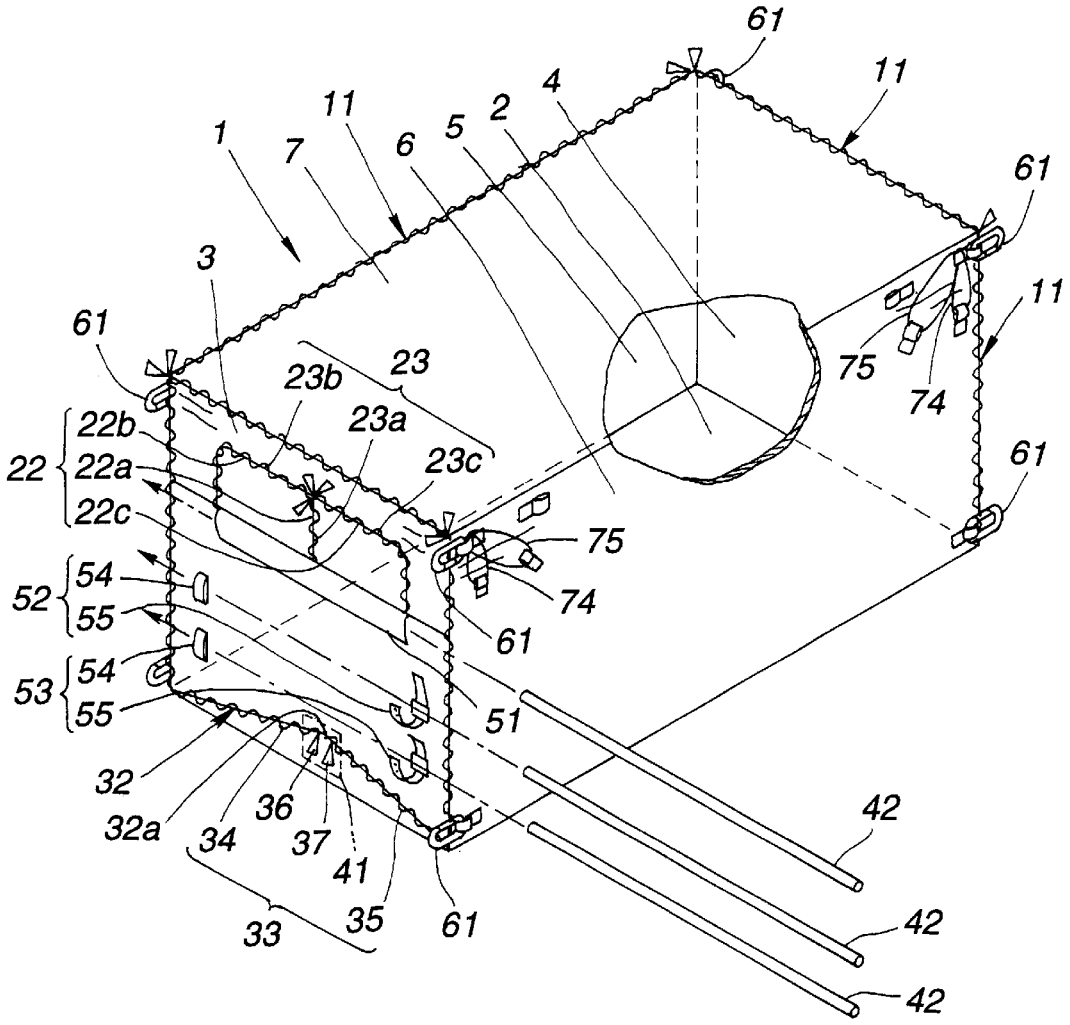
FIG. 1 is a partly fragmentary perspective view of a first embodiment of a container inner bag of the invention.
Figure 2:
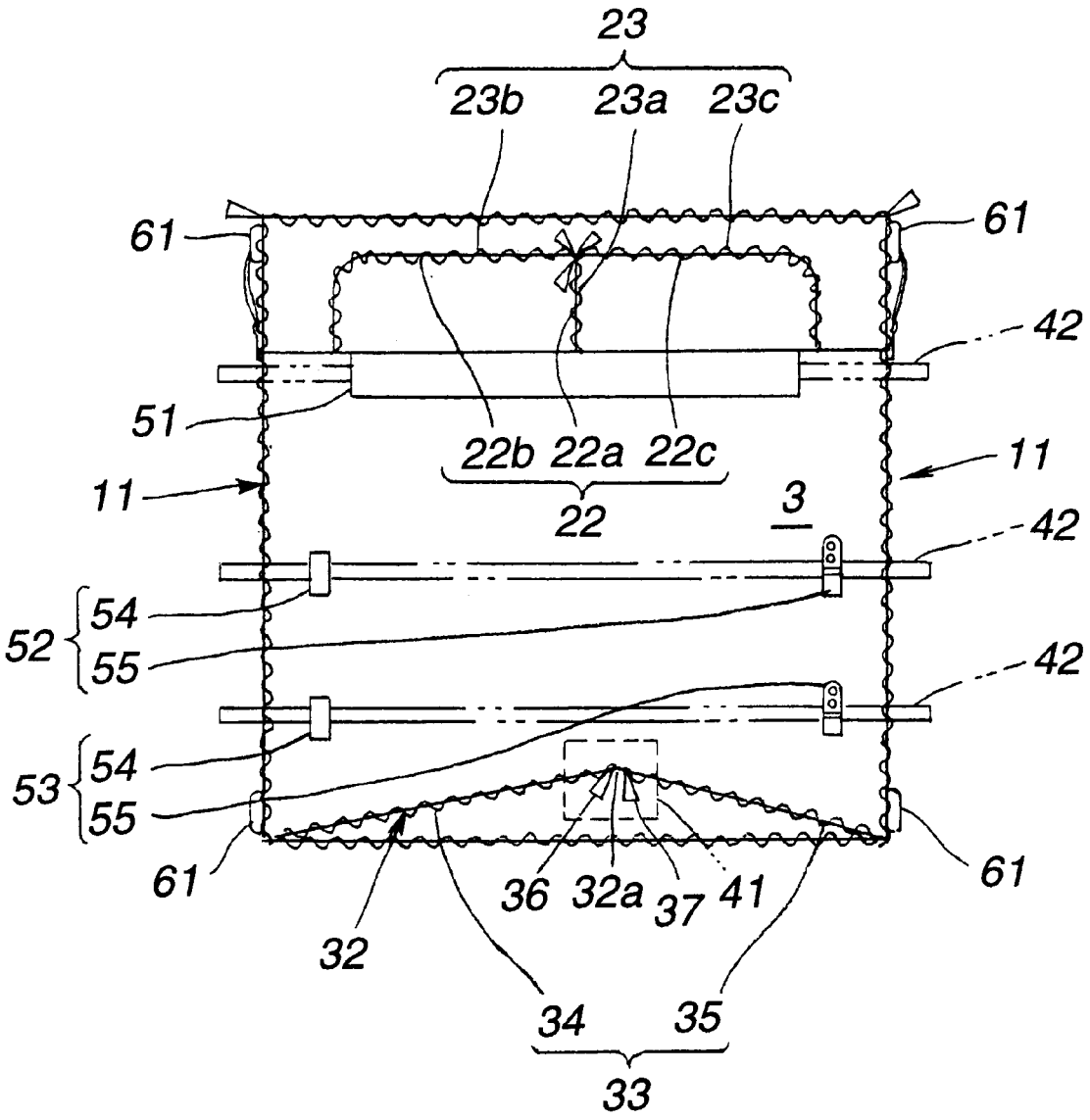
FIG. 2 is a front elevation of the first embodiment.

FIGS. 1 to 9 illustrate the first embodiment of a repetitively usable container inner bag 1.

The container inner bag 1 is formed into an elongated rectangular parallelepiped and made of a synthetic resin sheet, which is to be installed in a freight container and be filled with a large amount of content. The container inner bag 1 has a hexahedral structure including a bottom wall 2, front and rear walls 3 and 4, left and right side walls 5 and 6 and a top wall 7.

The container inner bag 1 is cut along four ridge portions at which the front and rear walls 3 and 4 encounter the left and right side walls 5 and 6, two ridge portions at which the front and rear walls 3 and 4 encounter the top wall 7, and a ridge portion at which the top wall 7 encounters the left side wall 5. The front and rear walls 3 and 4, the left and right side walls 5 and 6 and the top wall 7 are so constructed as to be joined and separated along the ridge portions by connecting and separating means 11 . . . 11, respectively. Namely, the front and rear walls 3 and 4, the left and right side walls 5 and 6 and the top wall 7 are joined and separated by the connecting and separating means along the ridge portions formed between the front and rear walls 3 and 4 and the left and right side walls 5 and 6, and three ridge portions among four ridge portions formed between the front and rear walls 3 and 4, the left and right side walls 5 and 6 and the top wall 7, respectively.

Figure 8:
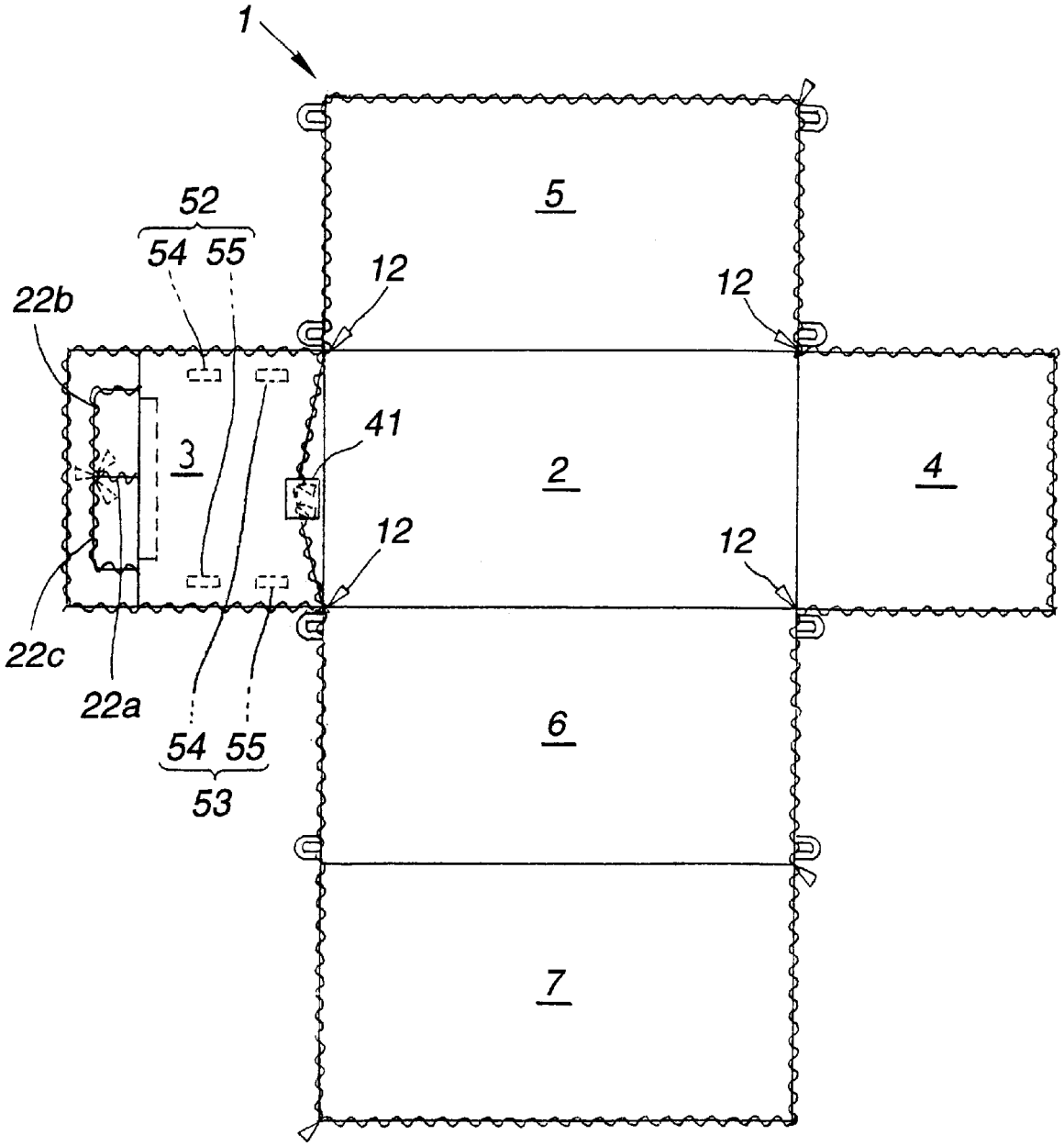
FIG. 8 is a development of the bag.

With the provision of the connecting and separating means 11 . . . 11, the walls can be joined along the ridge portions to form the hexahedron and separated along the ridge portions to be developed into one flat sheet made of synthetic resin as shown in FIG. 8. The front and rear walls 3 and 4 and the left and right side walls 5 and 6 are arranged to surround the bottom wall 2. The right side wall 6 and the top wall 7 are integrally formed.

The front wall 3 has, at an upper portion thereof, a cut portion 22 adapted to form a content insertion opening 21 (see FIG. 3) through which the content is filled into the bag, and at a lower portion thereof, a cut portion 32 adapted to form a content takeout opening 31 through which the content is taken out of the bag.

The cut portion 22 adapted to form the content insertion opening 21 includes a first cut segment 22*a* disposed at a center of the front wall 3 in a width direction and having a predetermined length extending substantially vertically. The cut portion 22 also includes a second cut segment 22*b* connected at one end thereof with an upper end of the first cut segment 22*a*. The second cut segment 22*b* extends along the ridge formed between the front wall 3 and the top wall 7 and the ridge formed between the front wall 3 and the left side wall 5. The cut portion 22 further includes a third cut segment 22*c* connected at one end thereof with the upper end of the first cut segment 22*a* and the upper end of the second cut segment 22*b*. The third cut segment 22*c* extends along the ridge formed between the front wall 3 and the top wall 7 and the ridge formed between the front wall 3 and the right side wall 6.

The cut portion 22 is adapted to be joined and separated by a connecting and separating means 23. The connecting and separating means 23 includes first, second and third slide fasteners 23*a*, 23*b* and 23*c* that separate and join the first, second and third cut segments 22*a*, 22*b* and 22*c*, respectively.

Figure 3:
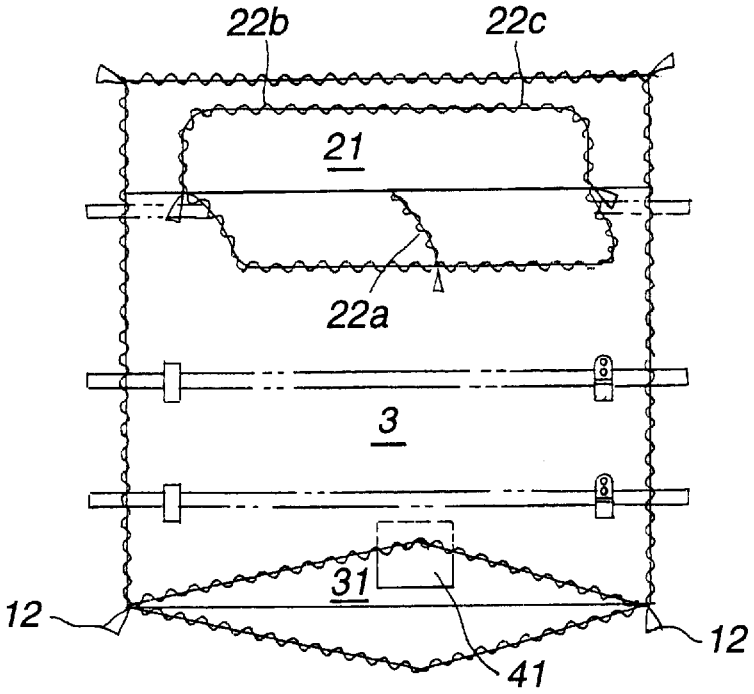
FIG. 3 is a front elevation of an opening in the full-open state.
Figure 4A:
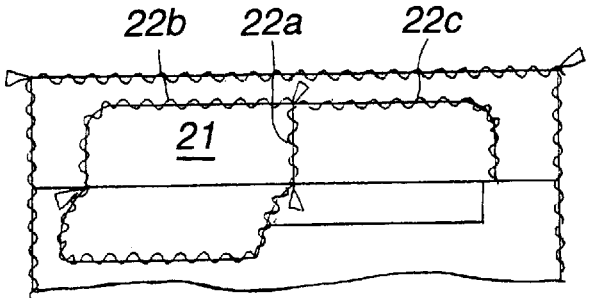
FIG. 4(A) is a front elevation of an important part, showing the opening in the half-open state.
Figure 4B:
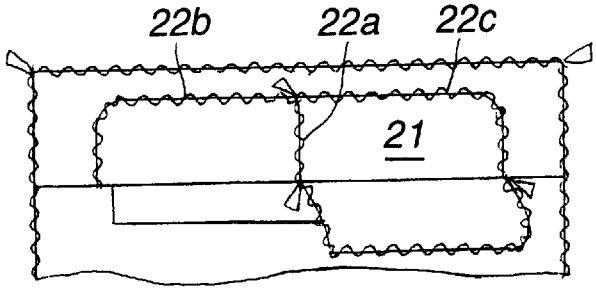
FIG. 4(B) is a front elevation of the important part, showing the opening in the half-open state.

The content insertion opening 21 is brought into the full-open state shown in FIG. 3, by separating the second and third cut segments 22*b* and 22*c* by the first, second and third slide fasteners 23*a*, 23*b* and 23*c*. The content insertion opening 21 comes into the left half-open state shown in FIG. 4(A), by separating the first and second cut segments 22*a* and 22*b* by the first and second slide fasteners 23*a* and 23*b*. The content insertion opening 21 comes into the right half-open state shown in FIG. 4(B), by separating the first and third cut segments 22*a* and 22*c* by the first and third slide fasteners 23*a* and 23*c*.

The cut portion 32 adapted to form the content takeout opening 31 is so arranged as to define a mountain-like triangular portion whose left and right ridge lines extend from a center located approximately on an elongation line of the first cut segment 22*a* for forming the content insertion opening 21, toward the left and right corners of the front wall.

The apex 32*a* of the mountain-like triangular portion defined by the cut portion 32 is located offset right or left (right in FIG. 1) from the downwardly extending elongation line of the first cut segment 22*a* adapted to form the content insertion opening 21.

The cut portion 32 defining the mountain-like triangular portion is adapted to be joined and separated by the connecting and separating means 33.

The connecting and separating means 33 is constituted by first and second slide fasteners 34 and 35.

The cut portion 32 is joined by sliding a slider 36 of the first slide fastener 34 from the left end of the front wall 3 to the apex 32*a* of the mountain-like triangular portion and sliding a slider 37 of the second slide fastener 35 from the right end of the front wall 3 to the apex 32*a*. Then, the content takeout opening 31 comes into the full-closed state.

The cut portion 32 is separated by sliding the slider 36 of the first slide fastener 34 from the apex 32*a* of the mountain-like triangular portion to the left end of the front wall 3 and sliding the slider 37 of the second slide fastener 35 from the apex 32*a* to the right end of the front wall 3. The content takeout opening 31 is brought into the full-open state.

A leak preventing flap 41 is disposed on an inner surface of the front wall 3. The leak preventing flap 41 is adapted to close a part of the content takeout opening near the apex 32*a* if the first and second slide fasteners 34 and 35 are forced to slide for some reason or other and the part of the opening is unnecessarily formed near the apex 32*a*. Then, the leak preventing flap 41 prevents the content from leaking out of the part of the opening. The leak preventing flap 41 is made of a synthetic resin sheet, a cloth or the like.

The front wall 3 has at upper, middle and lower portions thereof pipe supports 51, 52 and 53 for mounting reinforcing pipes 42 . . . 42 thereto.

The upper pipe support 51 has a tubular shape extending along a lower end of the content insertion opening 21. The reinforcing pipe 42 is inserted into the upper pipe support 51 and mounted thereby.

The middle and lower pipe supports 52 and 53 include pipe stop rings 54 disposed on one side of the front wall 3 and pipe stop belts 55 disposed on an opposite side thereof, respectively. The reinforcing pipe 42 is mounted to each of the middle and lower pipe supports by inserting one end of the pipe 42 and winding the belt 55 about an opposite end of the pipe 42.

The aims of forming the upper pipe support 51 into the tubular shape are to support securely and firmly the uppermost reinforcing pipe 42 subjected to a great load and to prevent a peripheral end portion of the cut portion 22 from drooping when the content insertion opening is formed.

Figure 6:
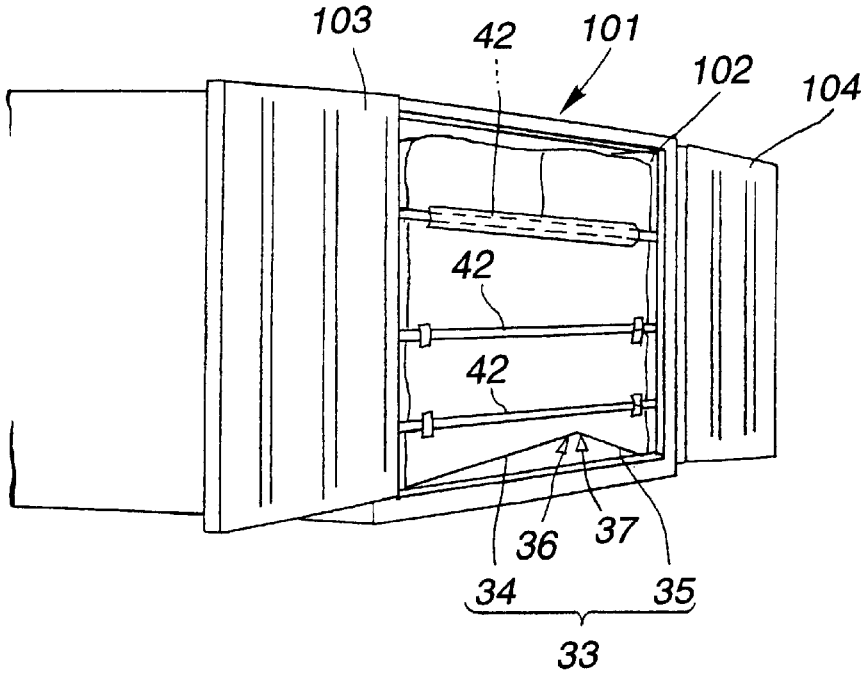
FIG. 6 is a perspective view showing a used condition of the bag.
Figure 7:
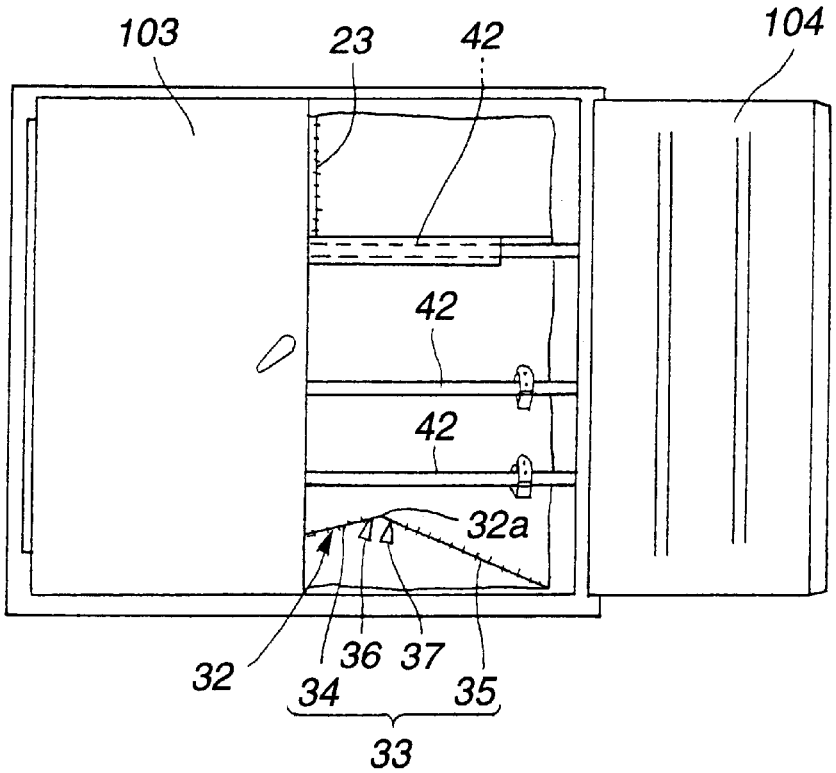
FIG. 7 is a front elevation of doors of a container, showing one in the open state.

The both ends of each of the reinforcing pipes 42 . . . 42 mounted on the upper, middle and lower-portions of the front wall are retained by being engaged with pipe fitting grooves 102, 102 that are formed on an inner wall surface of the container 101, as shown in FIG. 6.

Figure 5A:
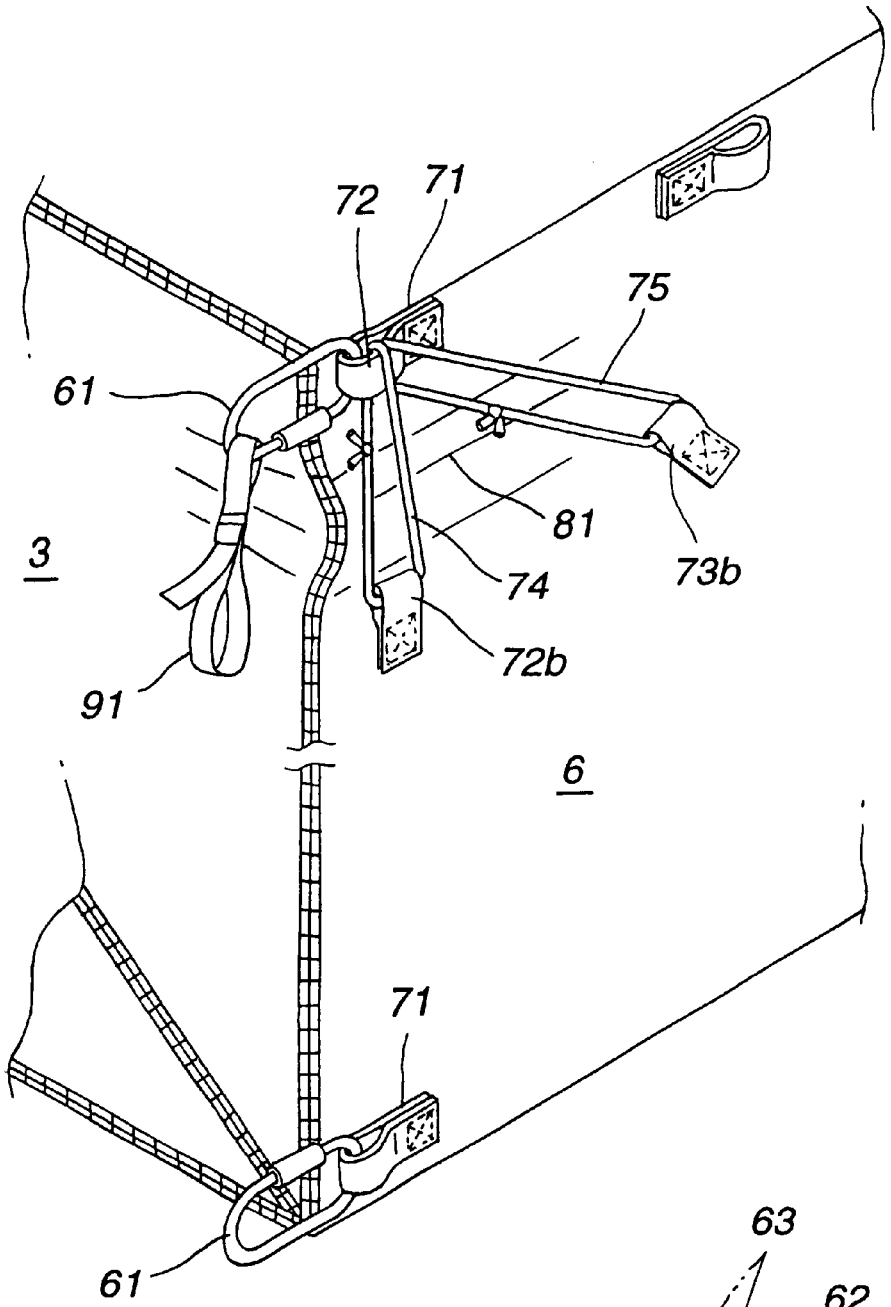
FIG. 5 is an enlarged perspective view of an engaging member.
Figure 5B:
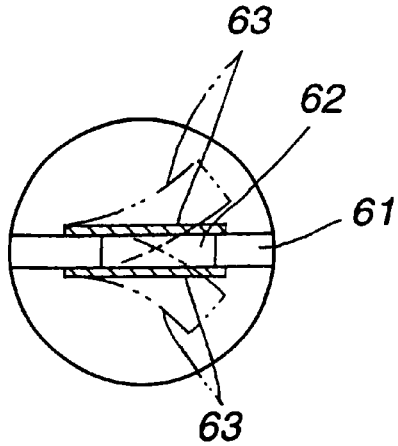

As illustrated in FIG. 1, engaging members 61 . . . 61 are disposed near four corners of each of the left and right side walls 5 and 6. The engaging members 61 . . . 61 are adapted to be engaged with hooks provided in the container. As illustrated in FIG. 5, each of the engaging members 61 is configured to a C-shape having a cutout portion 62 that is cut out from an elliptic ring shape. The cutout portion 62 is opened and closed by a tubular cutout-portion opening and closing member 63 made of plastics. The plastic cutout-portion opening and closing member 63 configured to a cylindrical shape is readily flexibly coupled with the engaging member 61. As shown in a circled portion of FIG. 5, the cutout-portion opening and closing member 63 has one end portion press-fittingly fixed to one end of the engaging member 61 that faces to one side of the cutout portion 62. The cutout-portion opening and closing member 63 has an opposite end portion contacted or partly engaged with the other end of the engaging member 61 that faces to the opposed side of the cutout portion 62. Thus, the cutout-portion opening and closing member 63 can be detachably mounted to the engaging member 61 to open and close the cutout portion 62.

Fixing belts 71 are disposed on upper-corner portions of the respective left and right side walls 5 and 6 and retain the corresponding engaging members 61.

Each of the fixing belt 71 forms a loop 72 at one longitudinal end portion thereof and attached at the other longitudinal end portion to the upper-corner portion of each of the side walls in a fastening manner such as sewing. First and second looped elastic cord braids 74 and 75 are connected with the loop 72 as well as the engaging member 61 is connected therewith. The first looped elastic cord braid 74 is inserted into and bound to a loop of a fixing member 72*b* that is attached to the side wall below the fixing belt 71, and placed in a vertically expanded state. The second looped elastic cord braid 75 is inserted into and bound to a loop of a fixing member 73*b* that is attached to the side wall below the fixing belt 71, and placed in a slantly expanded state. Thus, the first and second looped elastic cord braids 74 and 75 are arranged to pull up the left and right side walls 5 and 6. A wall (fold) portion 81 is formed on the side walls 5 and 6 by the compressing force of the elastic cord braids 74 and 75, acting as an upward expansion slack. The wall portion 81 expands as the left and right side walls 5 and 6 are swelled upon filling the content into the container inner bag.

An auxiliary belt 91 for suspending the pipe 42 is connected with the engaging member 61 and retains the uppermost pipe 42.

Fixing belts 71, substantially the same as the above-described fixing belts, for mounting the engaging members 61 are attached to lower-corner portions of the respective side walls and support the corresponding engaging members 61 (see FIG. 5).

A manner of use of the container inner bag 1 will be explained hereinafter.

1. Mounting the container inner bag within the container (after assembling the inner bag by means of the slide fasteners):

(1) Engage the upper, lower, left and right engaging members 61 . . . 61 disposed near the rear wall 4, with the corresponding hooks disposed inside the container. When the end portion of the cutout-portion opening and closing member 63 that is contacted or engaged with the engaging member 61 is pressed against the hook, the cutout-portion opening and closing member 63 is inwardly flexed to guide the hook into the engaging member 61. The engaging member 61 can be then engaged with the hook. After engagement with the hook, if the end portion of the cutout-portion opening and closing member 63 that is contacted or engaged with the engaging member 61 is pressed against the hook, the cutout-portion opening and closing member 63 can be outwardly flexed to bring the engaging member 61 into disengagement from the hook. Accordingly, when the engaging members 61 . . . 61 are engaged with the hooks, the cutout-portion opening and closing members 63 close the cutout portions 62 to thereby prevent the engaging members 61 from falling off the hooks.

(2) Insert the pipe 42 into the tubular pipe support 51 on the front wall 3 and then fit the pipe 42 into the pipe fitting grooves 102.

(3) Engage the upper and lower engaging members 61 . . . 61 disposed on the front wall side of the left and right side walls, with the corresponding hooks disposed inside the container.

(4) Insert the one end of the pipe 42 into the ring 54 of the middle pipe support 52 and fasten the opposite end of the pipe 42 by the belt 55. Fit the ends of the pipe 42 into the pipe fitting grooves 102.

(5) As explained in (4), insert the one end of the pipe 42 into the ring 54 of the lower-most pipe support 53 and fasten the opposite end of the pipe 42 by the belt 55. Fit the ends of the pipe 42 into the pipe fitting grooves 102.

(6) Form the content insertion opening 21 in accordance with a loading (content filling) manner. (Namely, bring the content insertion opening into the right half-open state or the full-open state.)

2. Dismounting the container inner bag from the container and folding the bag.

(1) Take off the pipes 42 . . . 42 from the pipe supports 51–53.

(2) Disengage the upper and lower engaging members 61 . . . 61 on the left and right side walls 5 and 6 from the hooks disposed inside the container.

(3) Fold the left and right side walls 5 and 6.

(4) Fold the front wall 3 and the rear wall 4.

Figure 9:
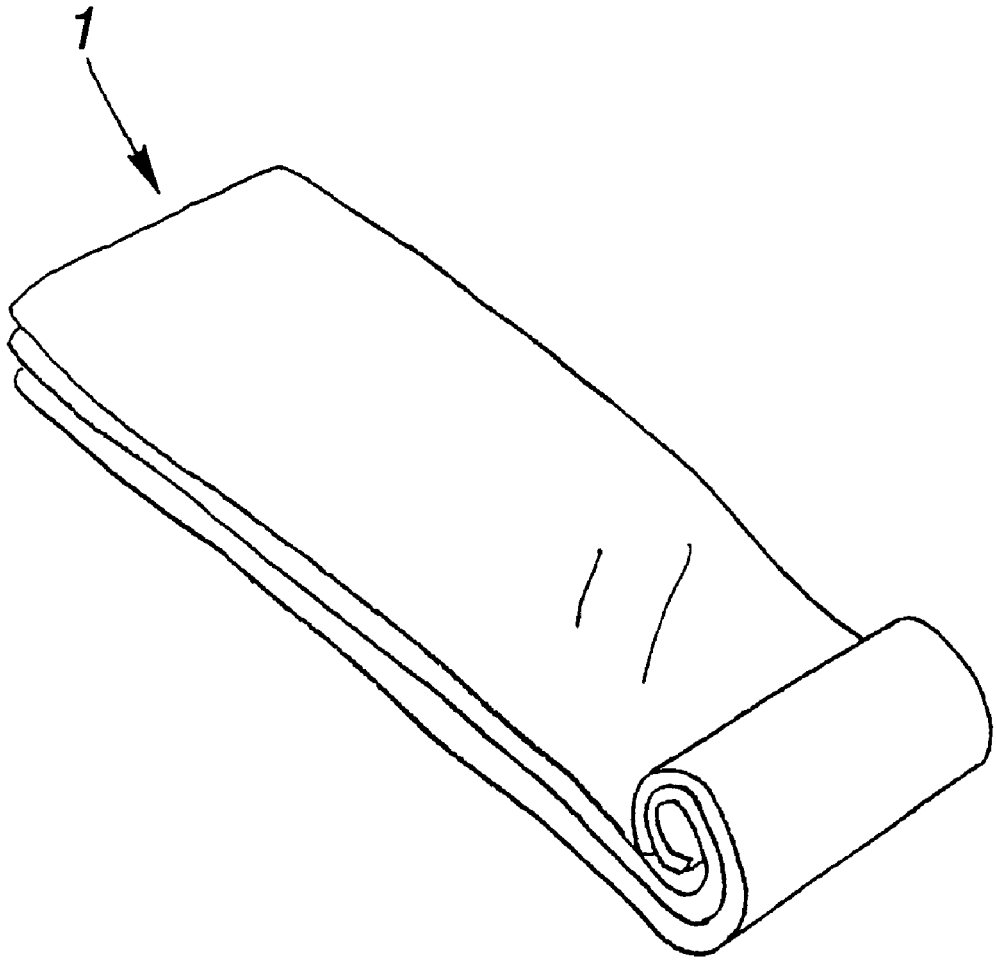
FIG. 9 is a perspective view of the bag in the folded state.
Figure 10:
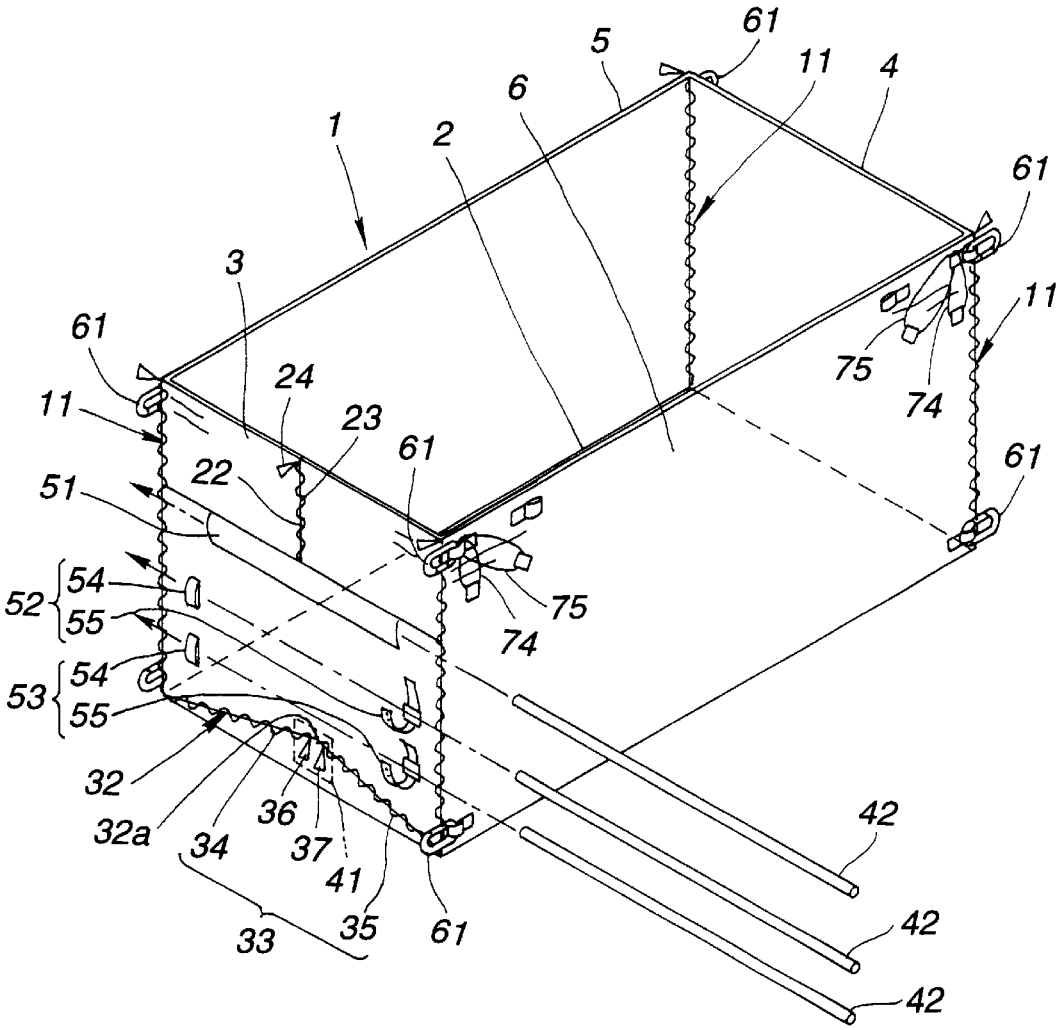
FIG. 10 is a perspective view of a second embodiment of the bag.
Figure 11:
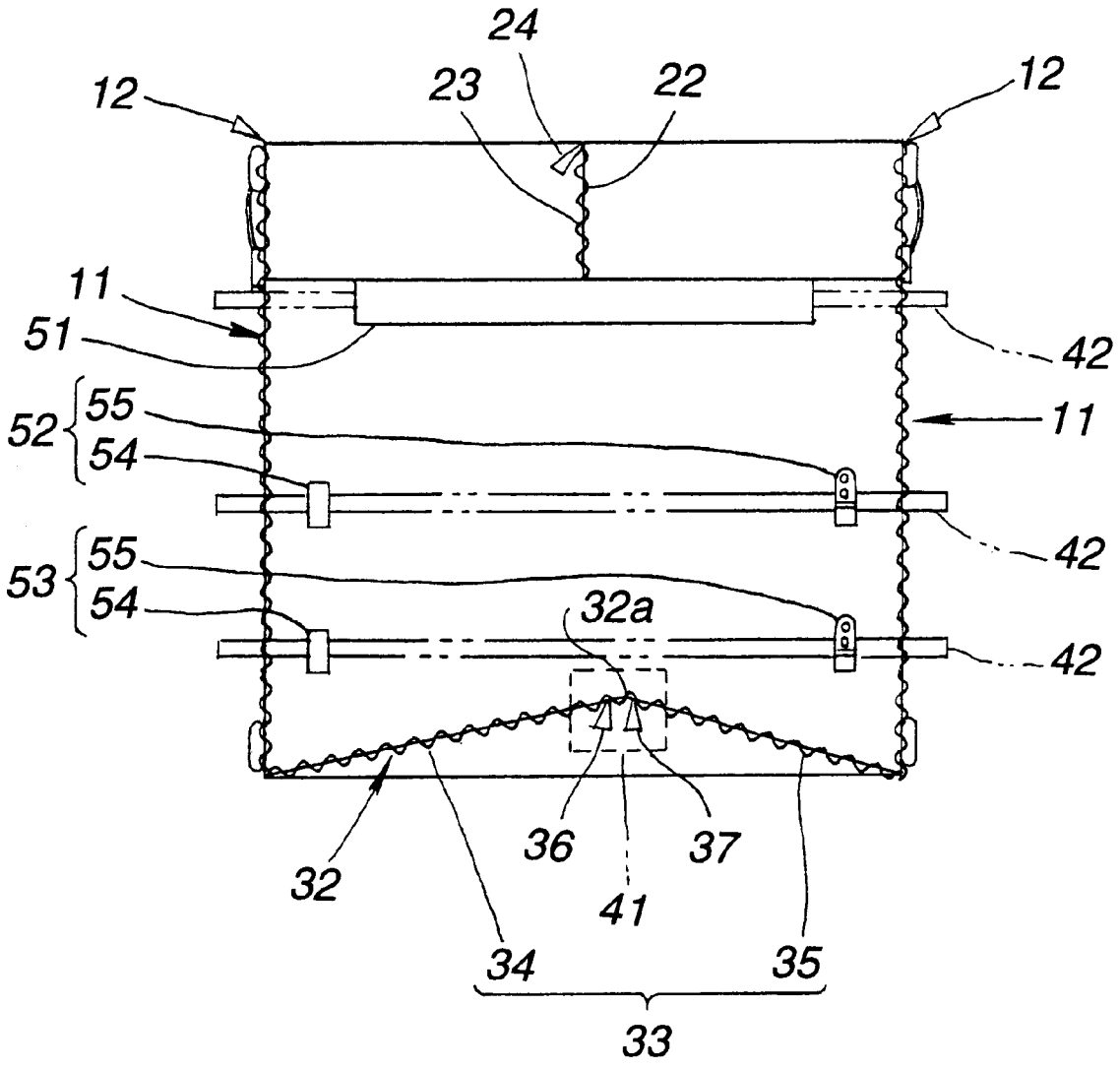
FIG. 11 is a front elevation of the second embodiment.

(5) Roll the container inner bag with the front and rear walls 3 and 4 and the left and right side walls 5 and 6 that are folded as described above, at one end portion thereof, and then bind the rolled bag with a band or cord (see FIG. 9). Unroll and develop the rolled container inner bag at another place and clean the unrolled bag by a cleaning method such as air blow. After the cleaning, close the slide fasteners and fold the container inner bag and then store the folded bag.

FIGS. 10 to 13 illustrate the second embodiment of the container inner bag 1.

The container inner bag 1 has a pentahedral structure including a bottom wall 2, front and rear walls 3 and 4 and left and right side walls 5 and 6.

The container inner bag 1 is cut along four ridge portions at which the front and rear walls 3 and 4 encounter the left and right side walls 5 and 6. These walls are so constructed as to be joined and separated along the ridge portions by connecting and separating means 11 . . . 11, respectively.

The connecting and separating means 11 . . . 11 are in the form of a slide fastener. The walls cut are joined along the ridge portions to form the pentahedral structure by sliding sliders 12 of the slide fasteners in one (upward) direction. The walls joined are separated along the ridge portions by sliding the sliders 12 in an opposite (downward) direction. The container inner bag is developed to one sheet shown in FIG. 13, in which the bottom wall 2 is surrounded by the front and rear walls 3 and 4 and the left and right side walls 5 and 6.

The front wall 3 has, at an upper portion thereof, a cut portion 22 adapted to form a content insertion opening 21 through which the content is filled into the bag, and the connecting and separating means 11 . . . 11. The front wall 3 also has, at a lower portion thereof, a cut portion 32 adapted to form a content takeout opening 31 through which the content is taken out from the bag.

The cut portion 22 adapted to form the content insertion opening 21 is disposed at a center of the front wall 3 in a width direction and has a predetermined length extending substantially vertically from an upper end of the front wall 3 toward a lower end thereof.

The cut portion 22 is adapted to be joined and separated by a connecting and separating means 23.

Figure 12:
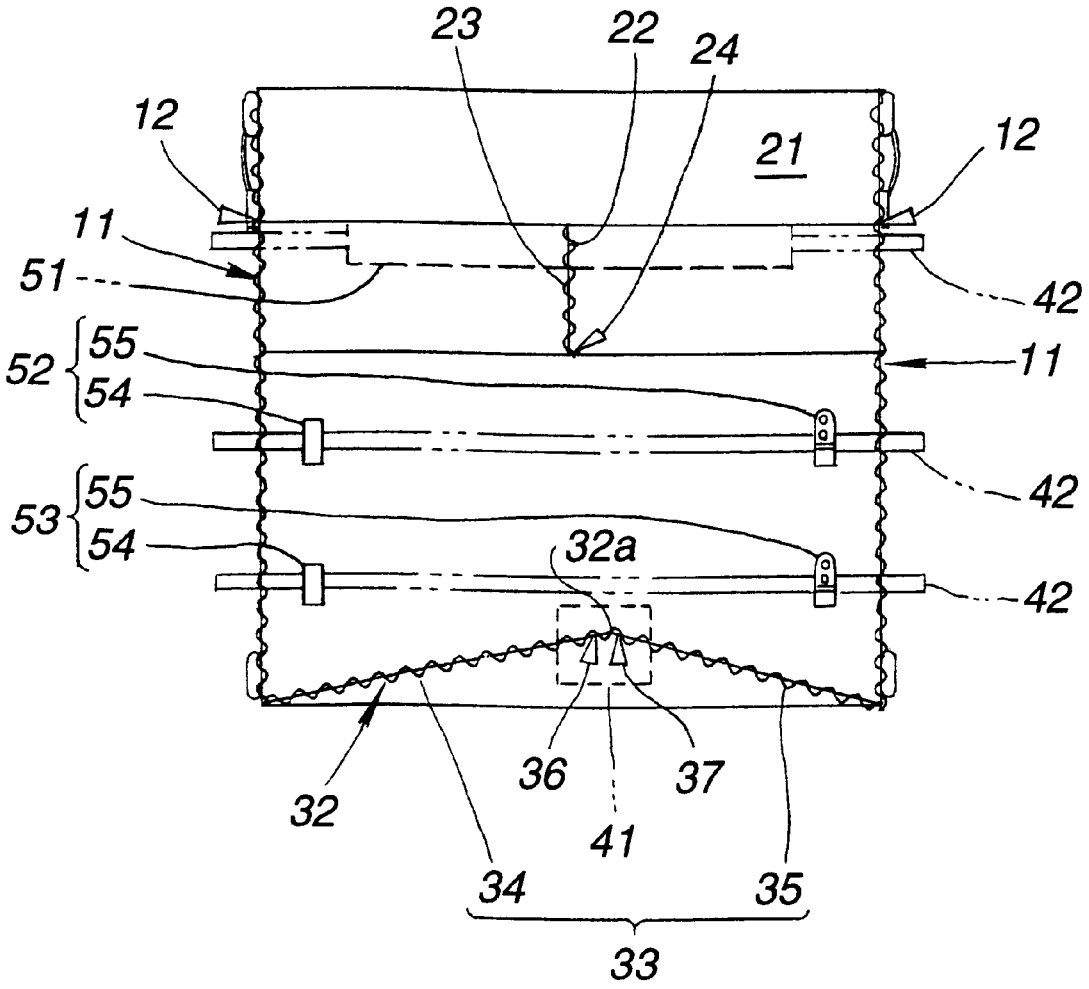
FIG. 12 is a front elevation of an opening in the open state.
Figure 13:
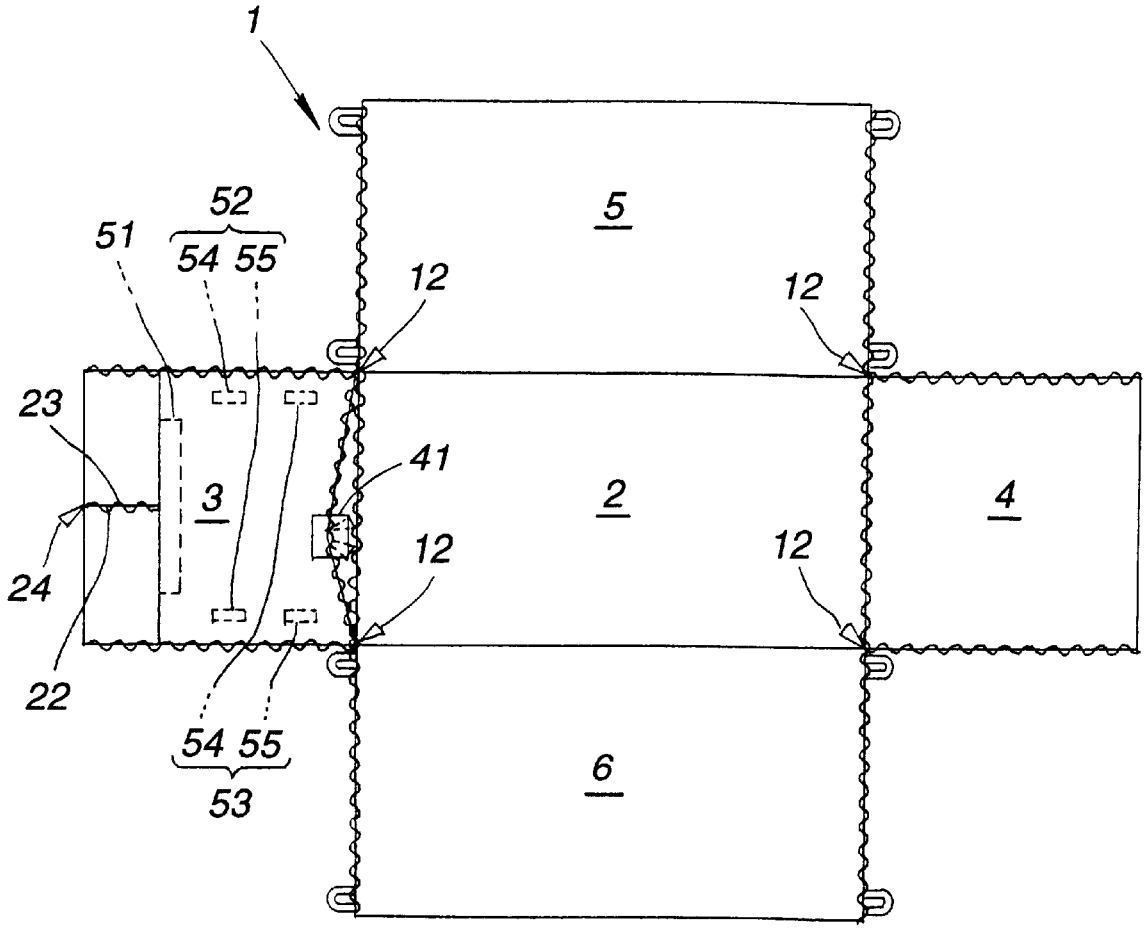
FIG. 13 is a development of the bag.
Figure 14:
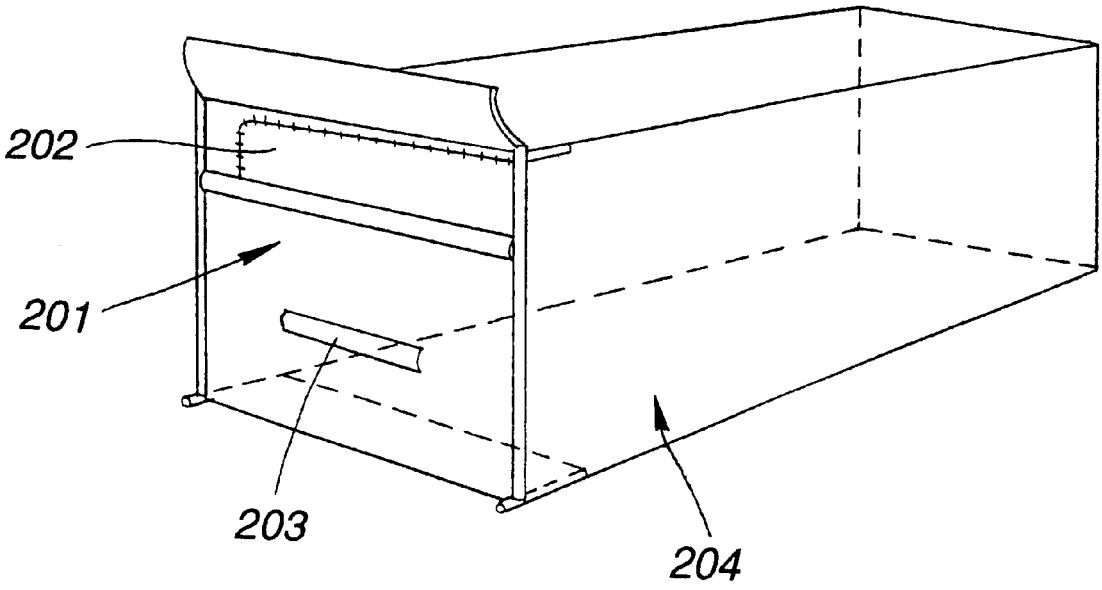
FIG. 14 is a perspective view of a conventional art.

The connecting and separating means 23 is in the form of a slide fastener. The content insertion opening 21 is closed by upwardly moving a slider 24 of the slide fastener to join the cut portion 22. Of course, as shown in FIG. 12, the opening 21 can be formed into a generally elongated rectangular shape by partly moving the connecting and separating means 11 . . . 11 on both sides of the front wall 3 while the cut portion 22 is kept joined.

Other arrangements of this embodiment is the same as those of the first embodiment, in which like reference numerals denote like parts and therefore repetitive explanations therefor are omitted.

INDUSTRIAL APPLICABILITY

The container inner bag of the present invention is useable in transportation by not only shipping but also railroad such as electric cars and trains, and motor truck.

What is claimed is:

1. A repetitively useable container inner bag comprising: a container inner bag for mounting into a freight container and filled with a large amount of content and made of a synthetic resin sheet, the container inner bag having an elongated rectangular parallelepiped shape including at least a bottom wall, front and rear walls and left and right side walls;

connecting and separating means for joining and separating the front wall and the left and right side walls along ridges at which the front wall encounters the left and right side walls, and the rear wall and the left and right side walls along ridges at which the rear wall encounters the left and right side walls, respectively;

a cut portion adapted to form at an upper portion of the front wall a content insertion opening through which the content is filled into the bag, and a cut portion adapted to form at a lower portion of the front wall a content takeout opening through which the content is taken out of the bag; and connecting and separating means for joining and separating said cut portion adapted to form the content insertion opening and said cut portion adapted to form the content takeout opening, respectively.

2. A repetitively useable container inner bag as claimed in claim 1, wherein the container inner bag of the elongated rectangular parallelepiped shape has a hexahedral structure including the bottom wall, the front and rear walls, the left and right side walls and a top wall, wherein the front and rear walls and the left and right side walls are adapted to be joined and separated by the connecting and separating means along the ridges formed between the front and rear walls and the left and right side walls, and wherein the front and rear walls, the left and right side walls and the top wall are adapted to be joined and separated by the connecting and separating means along three ridges among four ridges formed between the front and rear walls and the left and right side walls and the top wall.

3. A repetitively useable container inner bag as claimed in claim 1, wherein the container inner bag of the elongated rectangular parallelepiped shape has a pentahedral structure including the bottom wall, the front and rear walls and the left and right side walls, and wherein the front and rear walls and the left and right side walls are adapted to be joined and separated by the connecting and separating means along the ridges formed between the front wall and the left and right side walls and the ridges formed between the rear wall and the left and right side walls, respectively.

4. A repetitively useable container inner bag as claimed in claim 1, wherein said cut portion adapted to form the content insertion opening comprises a first cut segment disposed at a center of the front wall in a width direction and having a predetermined length extending in a vertical direction, a second cut segment connected at one end thereof with an upper end of said first cut segment and extending along the ridge formed between the front wall and the top wall and the ridge formed between the front wall and one of the side walls, and a third cut segment connected at one end thereof with the one end of said second cut segment and the upper end of said first cut segment and extending along the ridge formed between the front wall and the top wall and the ridge formed between the front wall and the other of the side walls, and wherein said cut portion adapted to form the content takeout opening is so arranged as to define a mountain-like triangular portion whose left and right ridge lines extend from a center located approximately on an elongation line of said first cut segment toward the left and right corners of the front wall.

5. A repetitively useable container inner bag as claimed in claim 1, wherein the cut portion adapted to form the content insertion opening is disposed at a center of the front wall in a width direction and has a predetermined length substantially vertically extending from an upper end of the front wall toward a lower end thereof, and wherein said cut portion adapted to form the content takeout opening is so arranged as to define a mountain-like triangular portion whose left and right ridge lines extend from a center located approximately on an elongation line of said cut portion adapted to form the content insertion opening, toward the left and right corners of the front wall.

6. A repetitively useable container inner bag as claimed in claim 1, wherein the connecting and separating means include a slide fastener.

7. A repetitively useable container inner bag as claimed in claim 4, wherein said cut portion adapted to form the content takeout opening is arranged such that an apex of the mountain-like triangular portion is offset toward either one of the ridges formed between the front wall and the side walls from the center of the front wall in the width direction.

8. A repetitively useable container inner bag as claimed in claim 4, wherein a leak preventing flap is provided for preventing the content from leaking from near an apex of the mountain-like triangular portion defined by said cut portion adapted to form the content takeout opening, said leak preventing flap being disposed behind the apex.

9. A repetitively useable container inner bag as claimed in claim 1, wherein a pipe support is provided for mounting a reinforcing pipe, said pipe support being disposed on the front wall.

10. A repetitively useable container inner bag as claimed in claim 1, wherein engaging members engageable with hooks disposed inside the container are disposed near four corners of each of the left and right side walls, said engaging members being configured to a C-shape having a cutout portion that is cut out from a generally circular ring shape, said cutout portion being opened and closed by a tubular cutout-portion opening and closing member made of plastics.

11. A repetitively useable container inner bag as claimed in claim 1, wherein the left and right side walls include expandable wall portions, respectively.

* * * * *